United States Patent [19]

Takeshima et al.

[11] Patent Number: 4,485,533

[45] Date of Patent: Dec. 4, 1984

[54] SLIDE FASTENER CHAIN AND METHOD OF MANUFACTURING THE SAME

[75] Inventors: Kiyoshi Takeshima, Namerikawa; Yoshinori Nakada, Kurobe, both of Japan

[73] Assignee: Yoshida Kogyo K.K., Tokyo, Japan

[21] Appl. No.: 452,286

[22] Filed: Dec. 22, 1982

[30] Foreign Application Priority Data

Dec. 29, 1981 [JP] Japan ..... 56-212490

[51] Int. Cl.[3] ..... A44B 19/36

[52] U.S. Cl. ..... 24/383; 24/382

[58] Field of Search ..... 24/382, 383, 433, 434, 24/435

[56] References Cited

U.S. PATENT DOCUMENTS

| | | | |
|---|---|---|---|
| 3,340,579 | 9/1967 | Tamura | 24/383 |
| 3,533,140 | 10/1970 | Waldes | 24/383 |
| 3,540,090 | 11/1970 | Takamatsu | 24/383 |
| 3,845,526 | 11/1974 | Kawakami | 24/383 |
| 3,999,255 | 12/1976 | Warburton et al. | 24/383 |
| 4,187,591 | 2/1980 | Akashi | 24/383 |

FOREIGN PATENT DOCUMENTS 45-302 8/1970 Japan .

*Primary Examiner*—William E. Lyddane
*Assistant Examiner*—Peter A. Aschenbrenner
*Attorney, Agent, or Firm*—Hill, Van Santen, Steadman & Simpson

[57] ABSTRACT

A slide fastener chain comprises a pair of inter-engaged stringers including a pair of stringer tapes one longer than the other which have longitudinally staggered ends spaced from each other by a distance greater than the length of a slider which is to be mounted on the slide fastener chain. The coupling heads of a predetermined number of coupling elements on the longer stringer tape adjacent to the end of the shorter stringer tape and remote from the end of the longer stringer tape are cut off so that the coupling elements thus severed are kept uncoupled from opposite companion coupling elements on the shorter stringer tape. The slide fastener chain thus constructed can smoothly be threaded through the slider. The slide fastener chain in one form is fabricated by cutting a continuous slide fastener chain transversely fully thereacross to define a transverse edge of the chain, transversely fully across one of the stringers to form a transverse slit spaced from the transverse edge, and longitudinally across a certain number of coupling elements below the transverse slit to form a longitudinal slit cutting off the coupling heads, which are held between the opposite companion coupling elements.

14 Claims, 14 Drawing Figures

SLIDE FASTENER CHAIN AND METHOD OF MANUFACTURING THE SAME

BACKGROUND OF THE INVENTION

1. Field of the Invention

The present invention relates to a slide fastener chain having one end shaped to facilitate threading thereof into a slider, and a method of and a cutter for manufacturing such a slide fastener chain.

2. Prior Art

There have been known various individual or discrete slide fastener chains cut to lengths for consumer use and continuous slide fastener chains of factory-produced lengths not yet severed for individual use. The prior slide fastener chains, discrete or continuous, have ends cut transversely as straight edges or notched to remove an intermeshing portion from coupling elements. When the slide fastener chain with the straight or flat end is threaded through a slide fastener slider, intermeshing coupling elements at the flat chain end fail to separate easily or tend to remain coupled upon abutting against a connector post or separator in the slider. Another disadvantage experienced with the flat-end chain in the slider mounting process is that the chain end provides only a limited area that the operator can grip with finger-nail tips, but not fingers, and hence the slide fastener chain cannot be pulled through the slider with a sufficient force. This slider mounting operation is time-comsuming, less efficient, and frequently yields defective slide fastener products.

The slide fastener chain with the notched end is more advantageous in that coupling elements can smoothly be disengaged by the separator in the slider, and the notched end of the chain has a wider tape portion for the operator to grasp more firmly in threading the chain through the slider. However, where the coupling elements are sewn by sewing threads to the stringer tapes, coupling element debris on the notched end is liable to loosen and thus become staggered as the sewing threads unravel, preventing the chain from being introduced into the slider. The sewing threads as they unravel when the stringer tapes are cut off can get caught between the slider and coupling elements, making chain threading through the slider sluggish or impossible.

SUMMARY OF THE INVENTION

It is accordingly an object of the present invention to provide a slide fastener chain which has an end thereof shaped to facilitate manual threading thereof through a slide fastener slider.

Another object of the present invention is to provide a method of manufacturing such a slide fastener chain.

According to the present invention, a slide fastener chain shaped for smooth insertion through a slide fastener slider comprises a pair of interengaged stringers including a pair of stringer tapes one longer the other which have ends longitudinally staggered from each other by a distance greater than the length of the slider. A certain number of coupling elements on the longer stringer tape which are disposed below the end of the shorter stringer tape remotely from the end of the longer stringer tape are slit to cut off their coupling heads, which are held between adjacent coupling elements on the shorter stringer tape. The rows of coupling elements can easily be spread apart by a separator in the slider so that the slide fastener chain can smoothly and effectively be threaded through the slider with a minimum amount of force applied. The slide fastener chain is fabricated by cutting a continuous slide fastener chain transversely fully thereacross to define a transverse edge of the chain, transversely fully across one of the stringers to form a transverse slit spaced from the transverse edge, and longitudinally across a certain number of coupling elements below the transverse slit to form a longitudinal slit cutting off the coupling heads, which are held between the opposite companion coupling elements. The slide fastener chain can be cut simultaneously by a cutter of simple construction.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 1:
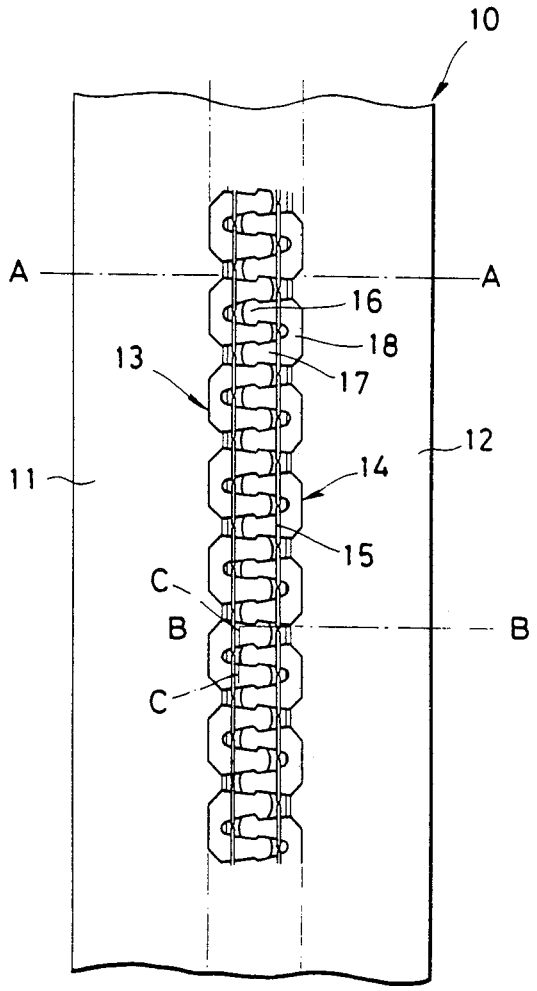
FIG. 1 is a fragmentary plan view of a continuous slide fastener chain having a factory-produced length.

FIG. 1 shows a factory-produced slide fastener chain 10 of continuous length comprising a pair of interengaged stringers including a pair of stringer tapes 11, 12 supporting on and along their confronting longitudinal edges a pair of zigzag or meandering rows of continuous coupling elements 13, 14, respectively, secured to the stringer tapes 11, 12 by sewing threads 15. The rows of coupling elements 13, 14 are made of macromolecular synthetic resin, each composed of a coupling head 16, a pair of legs 17 extending therefrom and blending respectively into a pair of connectors 18 disposed one on each side of the stringer tape and joined to two adjacent coupling elements. The sewing threads 15 extend across the legs 17 adjacent to the connectors 18. Each of the coupling elements 13, 14 is thus of a U shape astride the edge of the stringer tape 11, 12.

Figure 2:
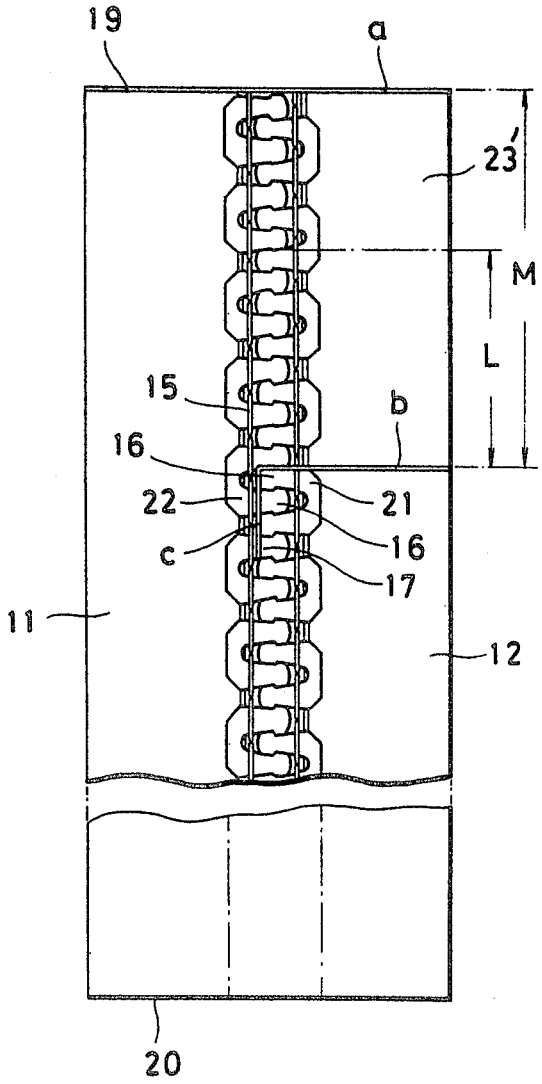
FIG. 2 is a fragmentary plan view illustrative of steps of cutting off an individual slide fastener chain from the continuous slide fastener chain shown in FIG. 1.
Figure 8:
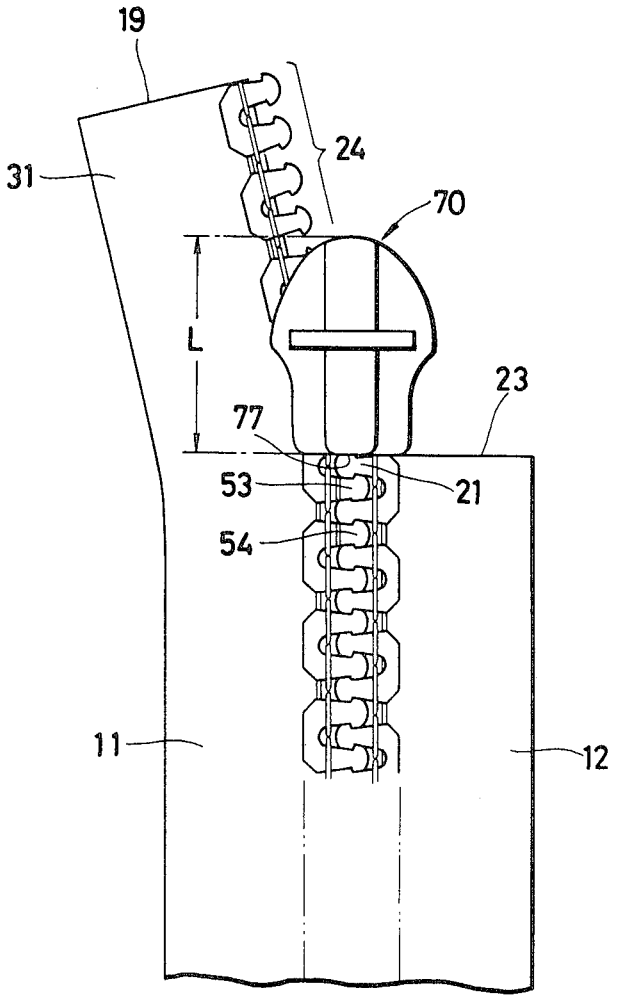
FIGS. 8 through 10 are fragmentary plan views showing the manner in which the slide fastener chain of FIG. 4 is threaded through a slide fastener slider.
Figure 9:
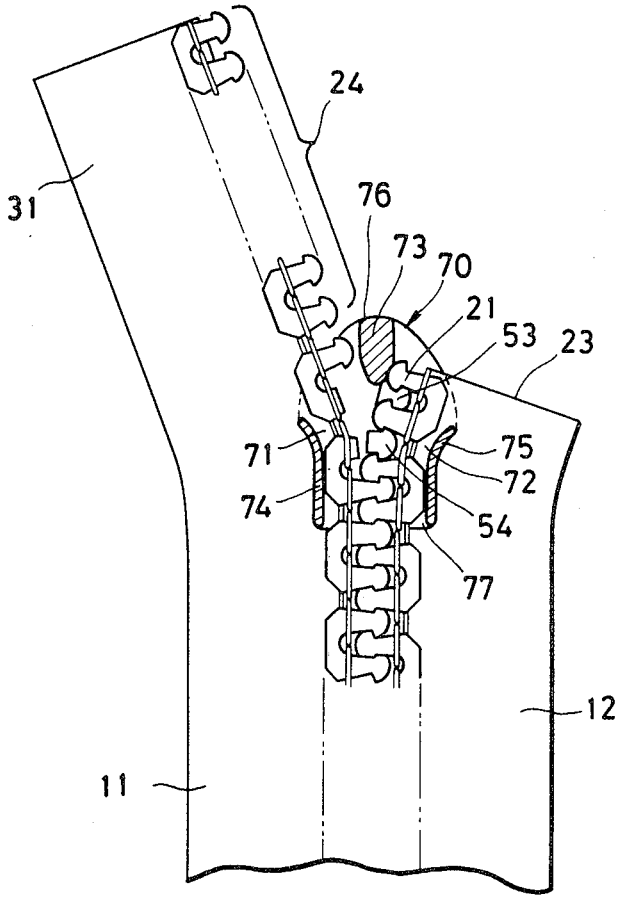

FIGS. 1 and 2 are illustrative of the manner in which the continuous slide fastener chain 10 is cut off by a method according to a first embodiment of the present invention. The slide fastener chain 10 is transversely cut off along a line A—A fully across the stringers including the stringer tapes 11, 12, transversely along a line B—B fully across one stringer including the stringer tape 12 and beyond the width of the row of coupling elements 14 mounted thereon, and longitudinally along a line C—C across the legs 17 of several adjacent coupling elements mounted on the stringer tape 11 below the line B—B. The line B—B is positioned remotely from the line A—A in the longitudinal direction of the chain 10 by a distance M longer than an overall length L of a slide fastener slider 70 (FIG. 8). The distance M is also selected to provide a tape grip portion long enough for the operator to hold the same firmly with the fingers during a slider mounting operation (described below). Each of the lines A—A, B—B should preferably be positioned between opposite coupling elements to avoid any damage by the cutter to adjacent coupling heads and legs. As shown in FIG. 2, a severed slide fastener chain has a transverse edge a cut along the line A—A and serving as an end 19 of the chain, a transverse slit b defined along the line B—B, and a longitudinal slit c defined along the line C—C and extending from the transverse slit b across at least two adjacent coupling elements 21, 22 beneath the slit b. The slit b goes as far as the coupling head 16 of the coupling element 21. The slit c extends alongside of the sewing threads 15 on the stringer tape 11 so as not to cut the sewing threads 15 and is flanked by the coupling heads of coupling elements on the stringer tape 12. In the illustrated embodiment, the slit c extends across four successive coupling elements on the stringer tapes 11, 12 to cut off the coupling heads 16 of the coupling elements mounted on the stringer tape 11. Preferably, the length of the slit c should not exceed the length of side flanges 74, 75 of a slider 70 (FIG. 9). When a plurality of such individual chains are cut off from the chain 10, the chain of FIG. 2 also has an end 20 opposite to the end 19, the end 20 being defined by severing the chain 10 across another line A—A to form the successive individual chain (not shown) beneath the chain shown in FIG. 2. The steps of cutting the slide fastener chain 10, or defining the edge a and the slits b, c, may be in any desired sequence.

Figure 11:
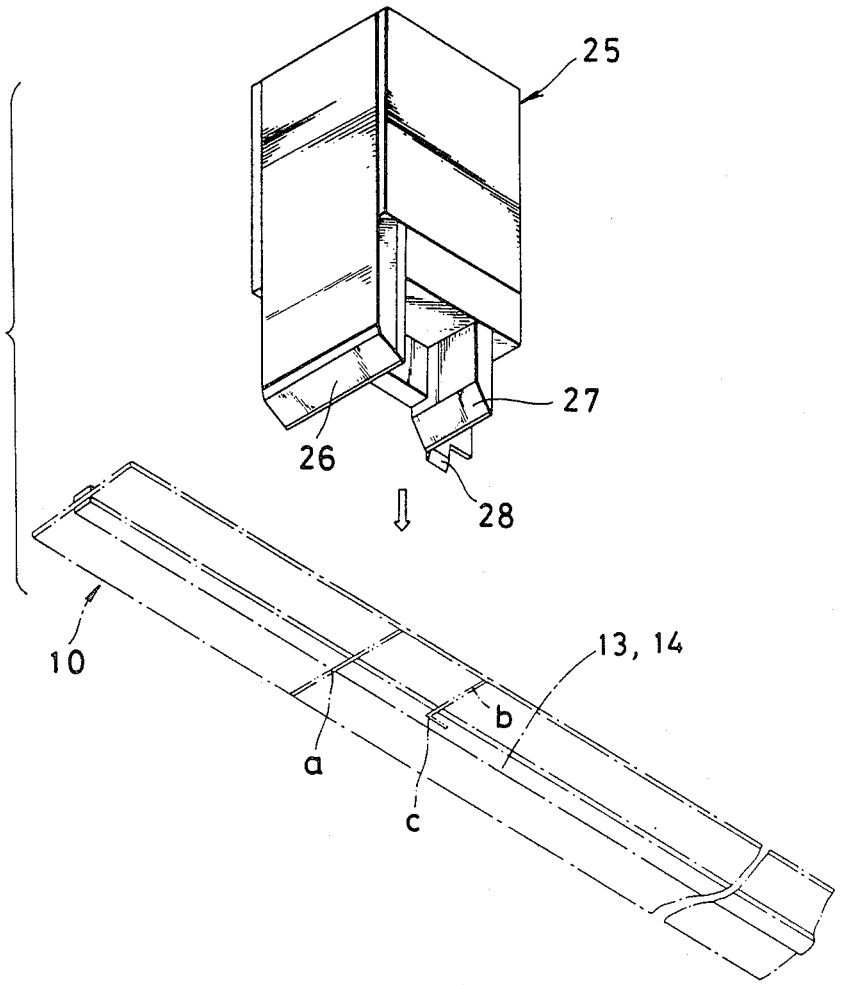
FIG. 11 is a perspective view of a cutter employed for fabricating the slide fastener chain shown in FIG. 2.
Figure 12:
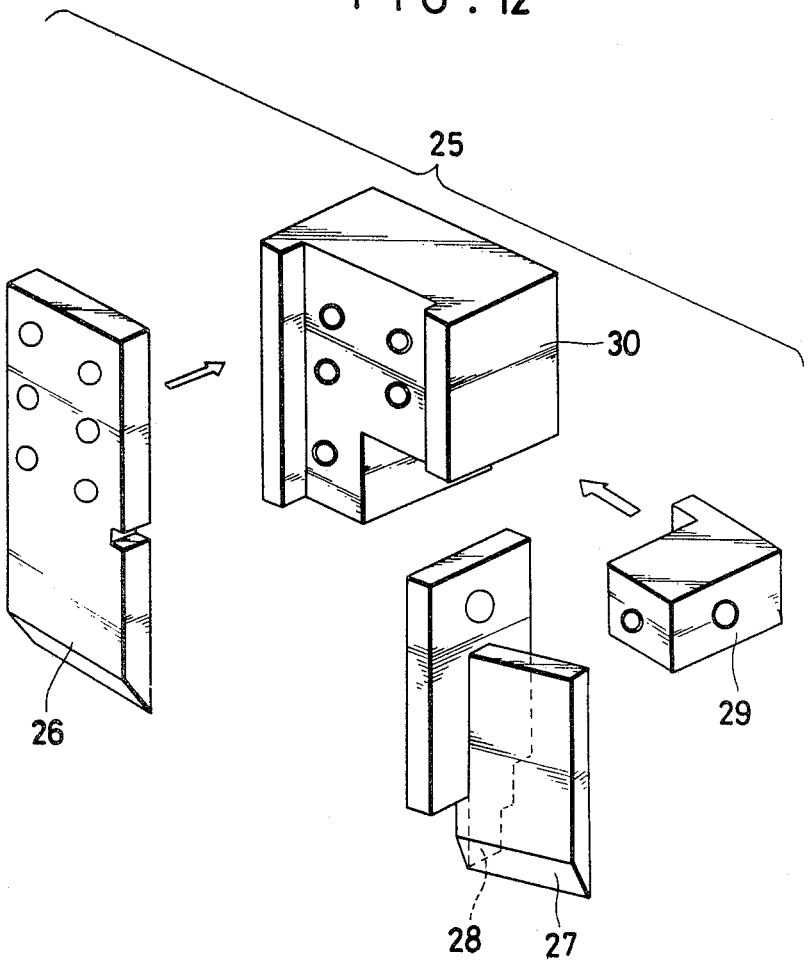
FIG. 12 is an exploded perspective view of the cutter illustrated in FIG. 11.

According to a method of a second embodiment, the foregoing steps of cutting the slide fastener chain are carried out at one time by a cutter 25 as shown in FIGS. 11 and 12. The cutter 25 comprises a first transverse cutter blade 26 having a length substantially equal to or larger than the width of the chain 10, a second transverse cutter blade 27 extending parallel to and spaced from the first cutter blade 26 and having a length substantially equal to the width of the stringer tape 12, and a third longitudinal cutter blade 28 contiguous to and extending from the second cutter blade 27 in perpendicular relation. The third longitudinal cutter blade 28 is located at one end of the second cutter blade 27 substantially centrally of the first cutter blade 26 in the longitudinal direction thereof. The first through third cutter blades 26, 27, 28 are removably fixed to a cutter block 30, and the second and third cutter blades 27, 28 are reinforced by an auxiliary block 29 attached to the cutter block 30. When cutting the chain 10, the cutter 25 is lowered against the chain 10 to enable the first through third cutter blades 26, 27, 28 to define the edge a and the slits b, c, respectively.

Figure 3:
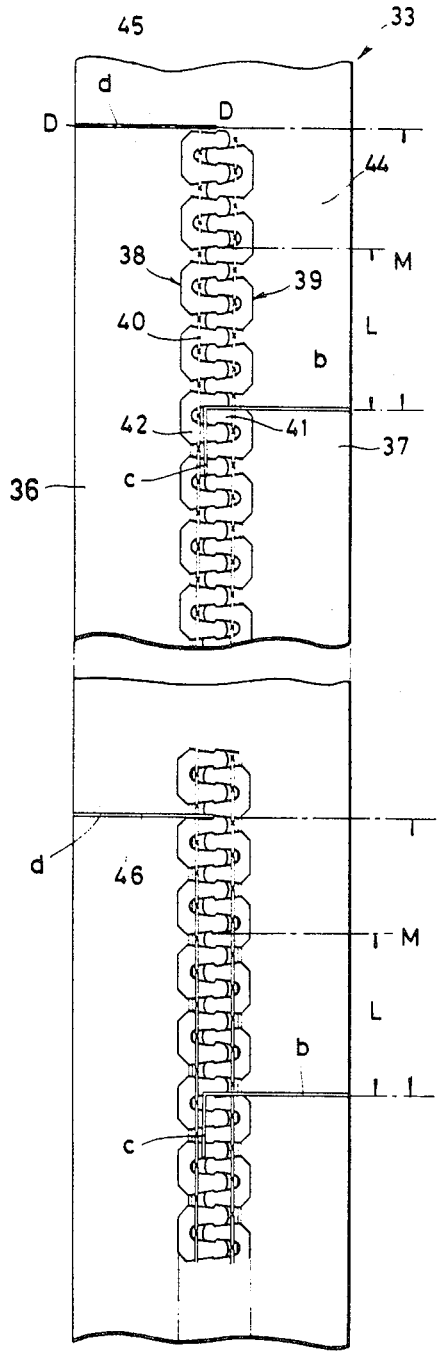
FIG. 3 is a fragmentary plan view showing steps of cutting off modified individual slide fastener chains from the continuous slide fastener chain of FIG. 1.

FIG. 3 shows a continuous slider fastener chain 33 cut according a third embodiment of the present invention. The slide fastener chain 33 comprises a pair of interengaged stringers including a pair of stringer tapes 36, 37 supporting, on and along their confronting longitudinal edges, a pair of rows of coupling elements 38, 39 of the zigzag type. The slide fastener chain 33 is cut transversely along a line D—D fully across one stringer including the stringer tape 36 to define a slit d, is cut transversely fully across the other stringer including the stringer tape 37 and beyond the width of the row of coupling elements 39 mounted thereon to define a slit b, and is cut longitudinally across the legs of several adjacent coupling elements below the slit b to define a slit c contiguous to the slit b. The slit b is positioned remotely from the slit d in the longitudinal direction of the chain 33 by the distance M longer than the overall length L of the slide fastener slider 70 (FIG. 8). Each of the slits d, b should preferably extend between opposite coupling elements 38, 39. The longitudinal slit c extends at least across two adjacent coupling elements 41, 42 beneath the slit b. The slit b goes as far as the coupling head of the coupling element 41. In the illustrated embodiment of FIG. 3, the slit c extends across four successive coupling elements on the stringer tapes 36, 37 to cut off the coupling heads of the coupling elements mounted on the stringer tape 37. The slits d, b, c may be formed in any desired sequence.

Figure 13:
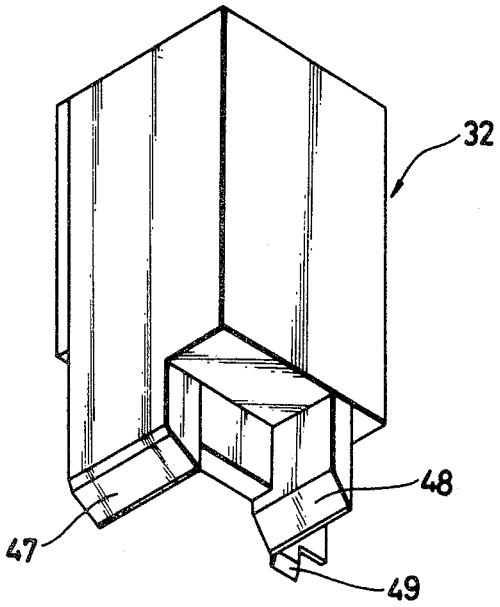
FIG. 13 is a perspective view of a cutter used for producing the slide fastener chain of FIG. 3.

The slits d, b, c can be formed simultaneously, according to a method of a fourth embodiment, by a cutter 32 as shown in FIG. 13, which comprises a first transverse cutter blade 47 of a length substantially the same as the width of the stringer tape 36, a second transverse cutter blade 48 extending parallel to and spaced from the first cutter blade 47 and having a length substantially equal to the width of the stringer tape 37, and a third longitudinal cutter blade 49 contiguous to and extending from the second cutter blade 48 in perpendicular relation thereto. The third cutter blade 49 is located at one end of the second cutter blade 48 substantially centrally between the first and second cutter blades 47, 48 in the longitudinal direction thereof. The first through third cutter blades 47, 48, 49 serve to define the slits d, b, c, respectively.

According to a method of a fifth embodiment, the step of defining the slit a (FIG. 2) or the slit d (FIG. 3) can be omitted from the methods of the above first through fourth embodiment, where an individual slide fastener chain is cut from a slide fastener chain, not a continuous slide fastener chain, which is slightly longer than the individual slide fastener chain of a final length for consumer use. Only the slits b, c need to be defined in the discrete slide fastener chain.

Figure 14:
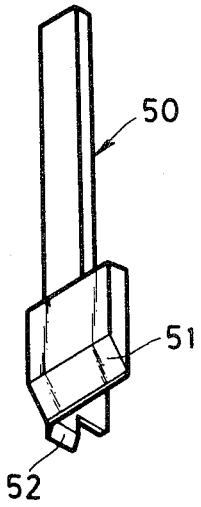
FIG. 14 is a perspective view of a cutter suitable for use in cutting an individual slide fastener chain according to the present invention.

FIG. 14 illustrates a cutter 50 for forming only the slits b, c at the same time. The cutter 50 has a first transverse cutter blade 51 having a length substantially equal to the width of the stringer tape 12 or 37, and a second longitudinal cutter blade 52 contiguous to and extending from the first cutter blade 51 for forming the slits b, c, respectively.

In the first, third and fifth embodiments, the individual slide fastener chain can be cut by a manually driven up-and-down cutter or a cutter drivable by a hand-held hammer. The straight edges on the first and second embodiments can be formed by a variety of cutters or scissors. When forming the edges and slits, the cutter blades of the cutters should be aimed at desired positions with care taken to avoid cutting of the sewing threads, which would otherwise tend to unravel and prevent the chain from being smoothly introduced through the slider, and also to avoid severance of the coupling heads of the coupling elements on the stringer tape 12, thus allowing the coupling elements on the tape 12 to be securely retained in position against wobbling motion and possible disengagement of the coupling elements.

Figure 4:
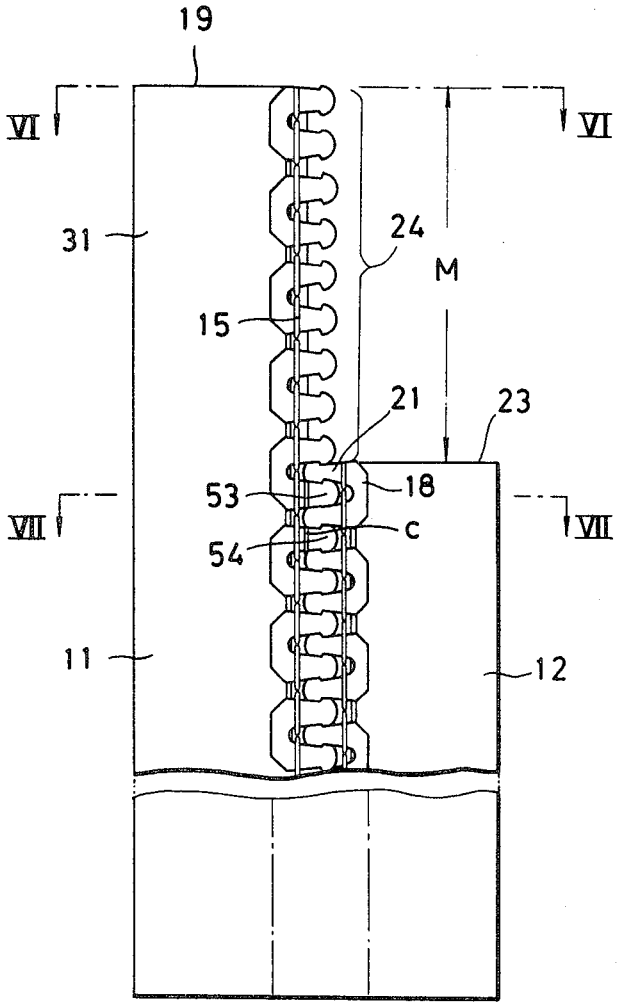
FIG. 4 is a fragmentary plan view of an individual slide fastener chain fabricated according to the present invention.

An individual slide fastener chain, shown in FIG. 4, readied for being threaded through a slider can be obtained by removing a stringer portion 23' from the stringer illustrated in FIG. 2. The slide fastener chain of FIG. 4 has a stringer portion 31 of the stringer tape 11 extending beyond a cut end 23 of the stringer tape 12 by the distance M. The stringer portion 31 includes a series of coupling elements 24 having no opposite or companion coupling elements to mate with. The two successive coupling elements on the stringer tape 11 below the endmost coupling element 21 on the stringer tape 12 have their coupling heads 53, 54 cut off by the slit c and sandwiched by the adjacent coupling elements on the stringer tape 12.

As illustrated in FIG. 9, the slider 70 has a generally Y-shaped guide channel including passages 71, 72 defined by the connector post or separator 73 and a pair of laterally spaced side flanges 74, 75. The slider 70 has a front end 76 on the separator 73 and a rear end 77, the length L of the slider 70 referred to above being measured between the front and rear ends 76, 77.

Figure 10:
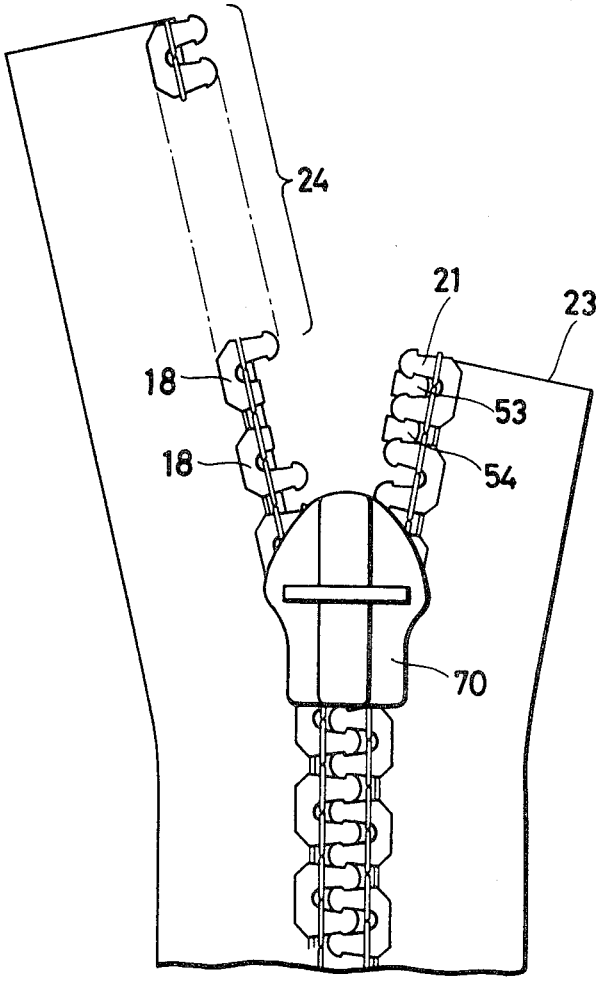

When the chain of FIG. 4 is to be threaded through the slider 70, the operator grips the stringer portion 31 with the thumb and forefinger of one hand and holds the slider 70 with the other hand. The series of coupling elements 24 is then threaded from the rear end 77 of the slider 70 through the passage 71 until the rear end 77 reaches the endmost coupling element 21 on the stringer tape 12 as shown in FIG. 8. Then, the stringer tape 12 is gripped firmly at the end 23 thereof and spread apart from the stringer tape 11. The endmost coupling element 21 and two successive coupling elements on the stringer tape 12 with the severed coupling heads 53, 54 held therebetween are easily and smoothly pulled into the passage 72 in the slider 70 without the risk of hitting and being blocked by the separator 73 in the slider 70, as shown in FIG. 9. The rows of coupling elements on the stringer tapes 11, 12 are successively disengaged as they are guided through the passages 71, 72 respectively, as illustrated in FIG. 10.

In the individual-length slide fastener chain thus produced, because the slit c extends alongside of the sewing threads 15 on the longer stringer tape 11 (so as not to cut the same) to cut off the coupling heads 53,54 of the coupling elements on the longer stringer tape 11 rather than on the shorter stringer tape 12, such headless coupling elements and their companion coupling elements disposed adjacent to the second end 23 are prevented from becoming loose and thus staggered. This guarantees proper and easy threading of the individual-length slide fastener chain through a slider.

Figure 5:
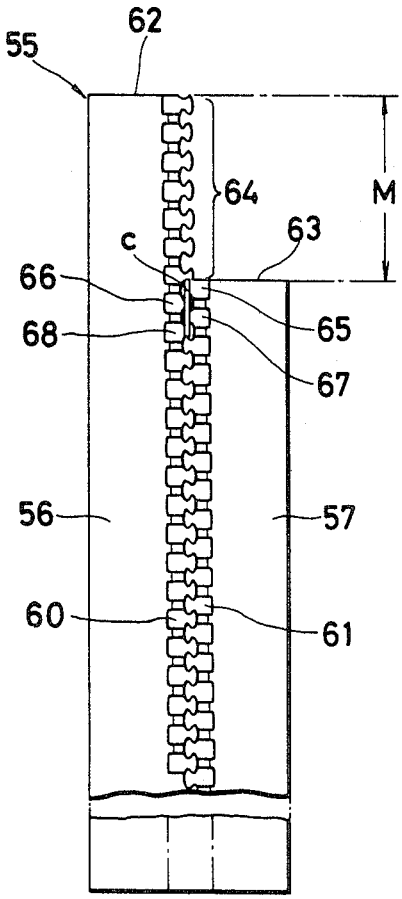
FIG. 5 is a fragmentary plan view of another individual slide fastener chain fabricated according to the present invention.
Figure 6:
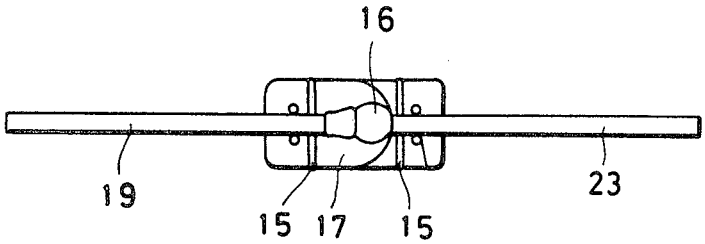
FIG. 6 is an enlarged cross-sectional view taken along line VI—VI of FIG. 4.
Figure 7:
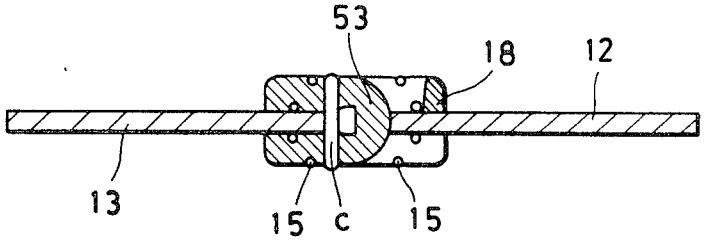
FIG. 7 is an enlarged cross-sectional view taken along line VII—VII of FIG. 4.

FIG. 5 shows a slide fastener chain 55 of the "injection-molded" type, fabricated according to the present invention. The slide fastener chain 55 comprises a pair of stringer tapes 56, 57 supporting on their confronting longitudinal edges a pair of rows of discrete injection-molded coupling elements 60, 61, respectively, made of macromolecular synthetic resin. The stringer tapes 56, 57 have cut ends 62, 63 spaced from each other by the distance M, leaving a series of coupling elements 64 on the stringer tape 56. Four coupling elements 65, 66, 67 and 68 below the tape end 63 are left uncoupled by a slit c defined across these coupling elements substantially centrally therebetween. The slide fastener chain 55 can be threaded through the slider 70 in the same manner as that shown in FIGS. 8 through 10.

The present invention is also applicable to the manufacture of continuous or individual slide fastener chains having continuous rows of helically coiled coupling elements made of synthetic resin or series of discrete coupling elements of metal which are sewn, molded, staked or otherwise mounted on stringer tapes.

Although various minor modifications may be suggested to those versed in the art, it should be understood that we wish to embody within the scope of the patent warranted hereon, all such embodiments as reasonably and properly come within the scope of our contribution to the art.

What is claimed is:

1. A slide fastener chain having a pair of interengaged stringers readied for being threaded through a slider, comprising:

(a) a pair of first and second stringer tapes having a pair of first and second longitudinally staggered ends, respectively, spaced longitudinally from each other by a distance greater than the length of the slider, said first stringer tape being longer than said second stringer tape; and (b) a pair of first and second rows of coupling elements mounted respectively on said first and second stringer tapes and including coupling heads intermeshing with each other, said first row of coupling elements including a series of coupling elements left uncoupled over said distance, and a predetermined number of coupling elements following said series of coupling elements below said second end and having their coupling heads cut off, whereby said predetermined number of coupling elements on said first stringer tape are separated from said opposite intermeshing coupling elements on said second stringer tape.

2. A slide fastener chain according to claim 1, said coupling heads of said predetermined number of coupling elements being held by opposite intermeshing coupling elements on said second stringer tape adjacent to said second end.

3. A slide fastener chain according to claim 1, said coupling heads of said predetermined number of coupling elements being cut off by a slit extending across the latter and flanked by the coupling heads of said opposite intermeshing coupling elements.

4. A slide fastener chain according to claim 3, said slit having a length substantially equal to the total width of four coupling elements.

5. A slide fastener chain according to claim 3, said slit extending from said second end in substantially perpendicular relation thereto.

6. A slide fastener chain according to claim 3, said first and second rows of coupling elements being secured to said first and second stringer tapes, respectively, by sewing threads, said slit extending alongside of said sewing threads of said first row.

7. A method of readying a slide fastener chain of a factory-produced length to be threaded through a slider, the chain comprising a pair of interengaged stringers including a pair of stringer tapes supporting respectively thereon a pair of rows of continuous coupling elements having intermeshing coupling heads, comprising the steps of:

(a) cutting the continuous slide fastener chain transversely fully thereacross and between two opposite coupling elements mounted on the stringer tapes, thereby defining an end of the slide fastener chain;

(b) cutting one stringer transversely fully thereacross and between two opposite coupling elements mounted on the stringer tapes to define a transverse slit spaced longitudinally from said end of the slide fastener chain by a distance greater than the length of the slider; and (c) cutting the other stringer longitudinally across a predetermined number of coupling elements thereon to define a longitudinal slit extending from said transverse slit remotely from said end of the slide fastener chain and thereby cutting of the coupling heads of said predetermined number of coupling elements.

8. A method according to claim 7, said cutting steps (a), (b) and (c) being effected simultaneously.

9. A method of readying a slide fastener chain of a factory-produced length to be threaded through a slider, the chain comprising a a pair of interengaged stringers including a pair of stringer tapes supporting respectively thereon a pair of rows of continuous coupling elements having intermeshing coupling heads, comprising the steps of:

(a) cutting the continuous slide fastener chain transversely fully across one stringer and between two opposed coupling elements mounted on the stringer tapes, thereby defining an end of said one stringer;

(b) cutting the other stringer transversely fully thereacross and between two opposed coupling elements mounted on the stringer tapes to define a transverse slit spaced longitudinally from said end by a distance greater than the length of the slider; and (c) cutting said one stringer longitudinally across a predetermined number of coupling elements thereon to define a longitudinal slit extending from said transverse slit remotely from said end and thereby cutting off the coupling heads of said predetermined number of coupling elements.

10. A method according to claim 9, said cutting steps (a), (b) and (c) being effected simultaneously.

11. A method of readying an individual slide fastener chain to be threaded through a slider, the chain comprising a pair of interengaged stringers including a pair of stringer tapes supporting respectively thereon a pair of rows of continuous coupling elements having intermeshing coupling heads, comprising the steps of:

(a) cutting the slide fastener chain transversely fully across one of the stringers and between two opposite coupling elements mounted on the stringer tapes to define a transverse slit spaced longitudinally from an end of the individual slide fastener chain by a distance greater than the length of the slider; and (b) cutting the other stringer longitudinally across a predetermined number of coupling elements thereon to define a longitudinal slit extending from said transverse slit remotely from said end of the individual slide fastener chain and thereby cutting off the coupling heads of said predetermined number of coupling elements.

12. A method according to claim 11, said cutting steps (a) and (b) being effected simultaneously.

13. A slide fastener chain having a pair of interengaged stringers readied for being threaded through a slider, comprising:

(a) a pair of first and second stringer tapes having a pair of first and second longitudinally staggered ends, respectively, spaced longitudinally from each other by a distance greater than the length of the slider, said first stringer tape being longer than said second stringer tape; and (b) a pair of first and second rows of coupling elements mounted respectively on said first and second stringer tapes and including coupling heads intermeshing with each other, said first row of coupling elements including a series of coupling elements left uncoupled over said distance, a predetermined number of coupling elements of said first and second rows following said series of coupling elements, below said second end and having their opposite coupling heads cut off, whereby said predetermined number of coupling elements on said first and second stringer tapes are separated from said opposite intermeshing coupling elements on each other's stringer tape.

14. A slide fastener chain according to claim 13, said cut off coupling heads of said predetermined number of coupling elements jointly defining a slit extending across the latter substantially centrally between said first and second coupling element rows and also extending from said second end in substantially perpendicular relation thereto.

* * * * *